US005556366A

United States Patent [19]

Studebaker

[11] Patent Number: 5,556,366

[45] Date of Patent: Sep. 17, 1996

[54] FINGER-PROTECTING PAPER CREASER

[76] Inventor: Charles E. Studebaker, 5753 Greendale Dr., Galloway, Ohio 43119

[21] Appl. No.: 245,891

[22] Filed: May 18, 1994

Related U.S. Application Data

[63] Continuation-in-part of Ser. No. 27,093, Mar. 5, 1993, Pat. No. 5,336,155, which is a continuation-in-part of Ser. No. 831,518, Feb. 5, 1992, abandoned.

[51] Int. Cl.[6] ..... B65H 45/12; B65H 45/28

[52] U.S. Cl. ..... 493/405

[58] Field of Search ..... 493/356, 405, 493/406, 439, 455, 456, 468; 428/99, 124

[56] References Cited

U.S. PATENT DOCUMENTS

| | | | |
|---|---|---|---|
| D. 223,640 | 5/1972 | Kemp | D19/65 |
| 793,220 | 6/1905 | O'neil | 493/406 |
| 1,192,519 | 7/1916 | Hammond | 493/406 |
| 1,217,870 | 2/1917 | Klaes | 2/21 |
| 1,229,312 | 6/1917 | Newhouse | 493/405 |
| 2,676,797 | 1/1951 | Mills | 493/406 |
| 2,712,933 | 12/1953 | Davidson | 493/406 |
| 2,997,296 | 1/1961 | La Bash | 493/439 |
| 4,081,907 | 4/1978 | Bosshold | 30/294 |
| 4,188,055 | 2/1980 | Green | 294/1 R |
| 4,261,608 | 4/1981 | Bradshaw | 294/25 |
| 4,579,552 | 4/1986 | Brannland | 493/455 |
| 4,744,196 | 5/1988 | Gallo | 53/375.4 |

*Primary Examiner*—Jack W. Lavinder
*Assistant Examiner*—Christopher W. Day
*Attorney, Agent, or Firm*—William Weigl

[57] ABSTRACT

A device is provided to protect one's fingers from abrasion and paper cuts whenever forming a creasing line. The device consists of a pair of hinged, open-ended laterally-positioned elongated arms which are capable of providing a controllable creasing pressure at inwardly-facing opposed creasing surfaces. One of the arms is provided with a finger-gripping means to enable firmly holding the device against slippage during use. The finger-gripping means can also be provided with a stiletto-type letter opener. One form of the device can be made to stand upright on a desk for ready grasping in the identical position in which it will be used, and also has outwardly-facing surfaces carrying an advertising message or logo which are easily readable when the device is placed in such upright position.

15 Claims, 1 Drawing Sheet

LOGO
ORDERS TO GO
SUB
HOT
COLD
SUBS
PIZZA
SHOP

FINGER-PROTECTING PAPER CREASER

This is a continuation-in-part of my U.S. Pat. Application Ser. No. 08/027,093 filed Mar. 5, 1993, now U.S. Pat. No. 5,336,155, which was a continuation-in-part of my U.S. patent application Ser. No. 07/831,518 filed Feb. 5, 1992, now abandoned.

BACKGROUND OF THE INVENTION

This invention relates primarily to an article or device for protecting a user's fingers from abrasion and paper cuts when creasing paper. A common example of use is creasing a letter-sized sheet or multiple sheets into three sections to enable enclosure in a business envelope for mailing. It may also be used for forming a crease line in a sheet of paper to enable tearing or slitting along the crease line.

When creasing a sheet in the customary manner, one known technique is to start by first doubling over a section of the sheet along one edge, pinching the starting point of the crease between one's fingers and then drawing or pulling the compressed fingertips along the line to be creased. Another known technique is to place the doubled-over sheet on a solid surface, press a finger or thumb against the paper and move either the paper or hand to make the crease. While either one of these approaches works well for a few operations, the fingers are subject to abrasion if repetitive creasing tasks are performed. Many paper stocks are coated with substances which can be very abrasive to the skin if the skin is constantly run across the paper. Additionally, receiving a paper cut from an edge of the paper is always a risk when creasing, if the user is not careful.

Creasing can also be done by using one's fingernails on both sides of a sheet, or on one side against an opposing finger. In doing either of these, however, it is often necessary to first form a fold by finger-pressing along the full length of the line to be creased to assure that the crease line will not stray, then returning to the starting point of the crease, pinching the fold line between the fingernails and drawing the nails across the prefolded line. Not only does this require two passes to creat a crease, it also runs some risk of snagging and damaging the paper, because of the minimal area of fingernail contact with the paper at the pressure point. The risk of a paper cut occurring is greater when creasing with fingernails rather than pressing one's fingertips together. While skin damage from a paper cut is often very slight, it can be very painful, particularly if the cut occurs beneath a fingernail.

SUMMARY OF THE INVENTION

The device of my invention serves to provide a manually-produced accurate, controllable-pressure crease in a single pass across the sheet, without resulting in abrasion to the person's fingertips. It comprises a pair of arms, preferably slightly flexible, connected together at a hinged portion. The arms ideally fit between the pressure points of one's thumb and forefinger when a crease is made. At least one of the arms is provided with means for preventing the fingers from slipping from the device as it is drawn along the line to be creased. Such means can take any of several different forms, such as a flange held between a pair of fingers during the creasing action or a finger-receiving opening or pocket.

In one preferred form, the creaser also incorporates a letter opener feature for slitting envelopes or paper sheet material, and also a paper combing feature for separating individual paper sheets from the top of a pile. The creaser has arms which are V-shaped outwardly from a hinge formed at the vertex of the V. The arms are preferably naturally biased apart to permit easy placement of the V over the starting point of the crease. The arms are then pressed together by the fingers, most handily and advantageously between the thumb and forefinger, and the fingers are then drawn along the line to be creased. In this form, the device may be made of a thermosetting plastic with a living hinge at the vertex of the V. The arms are preferably of equal length so the device can be made to stand upright as an inverted V on a desk, ready to be picked up and the device immediately used as taken. A logo or advertising message may be produced on the arms and be readily viewed from either side when the device is standing upright. The device may also serve as a novel form of business card.

The principal object of the invention is to provide a manually-operable paper folder and creaser which minimizes the effects of paper abrasion and paper cuts to the fingertips of the person performing the creasing.

An important object of the invention is to provide a device for forming a controllable-pressure crease, particularly to enable obtaining either a sharp or gentle crease, regardless of the number of sheets being creased.

Another object is to provide such a creasing device with a gripping means for resisting or preventing slippage of one's fingers from the device while performing a creasing function.

A further object is to provide an ambidextrous device for creasing with either the right or left hand.

Still another object is to provide an efficient means for simultaneuosly creasing a plurality of sheets with ease and accuracy.

A further object is to provide a creasing device which enhances tearing or slitting along the crease line.

Yet another object is to provide a creasing device which is capable of carrying an advertising message or logo, whereby the device can be used as a promotional item for products of the type with which the creaser may be associated.

An ancillary object is to enable the message or logo to serve as a business card which is constantly in view upon conversion to a desktop creaser.

Another object is to provide such a device which can be made to stand on a desk or other horizontal surface, ready to be used in the position in which it is picked up.

A further object is to combine portions of the creasing article of the invention with means capable of performing other functions, such as slitting of envelopes or roll facsimile paper, or combing individual sheets from the top of a pile, all while the article is held in the same manner regardless of which task is being performed.

Other objects will become apparent from the following description in which reference is made to the accompanying drawings.

IN THE DRAWINGS

DETAILED DESCRIPTION

Figures 1, 2, 3, 4, 5, 6, 7, 8, 9, 10:
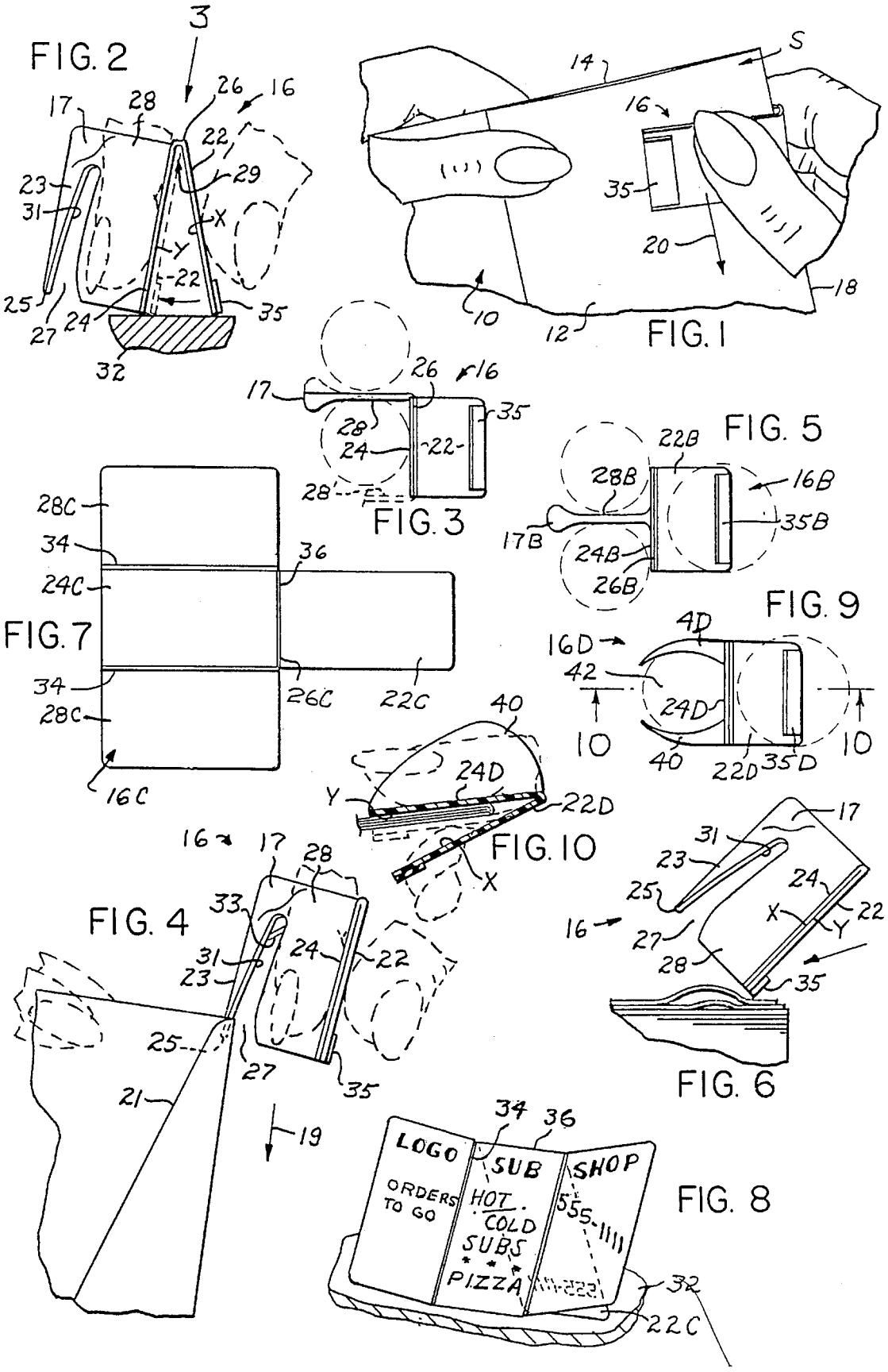
FIG. 1 is a pictorial depiction of a preferred form of my creaser being drawn along a line to be creased by a user's hand while the paper is held between a person's thumb and forefinger of the other hand.
FIG. 2 is a side view of a preferred form of my invention, illustrating the manner in which the creaser is grasped while it is standing upright on a horizontal surface.
FIG. 3 is a top view of the combined creaser/slitter/comb of FIG. 2 taken looking essentially in the direction of the arrow 3 of FIG. 2.
FIG. 4 illustrates the device of FIGS. 2 and 3 as it is held and used for slitting open an envelope.
FIG. 5 is a view of a modified form of the combined creaser/slitter/comb looking substantially in the same direction as in FIG. 3.
FIG. 6 is a view of the device performing a combing function on a pile of sheets by pushing the device away from the user.
FIG. 7 illustrates a simplified form of creaser as produced from a flat sheet of plastic or heavy paperboard, enabling printing with a logo or advertising on what will be its outwardly-facing sides when made to stand upright on a desktop.
FIG. 8 shows a creaser like that of FIG. 7 made into a printed business card standing on a desktop, ready to be picked up for use by either a right or left-handed user.
FIG. 9 illustrates still another modification of the creaser looking substantially in the same direction as in FIG. 3.
FIG. 10 is a cross-sectional view of the device of FIG. 9 and is taken looking in the direction of lines 10—10, illustrating how the creaser performs on multiple sheets of paper.

A sheet of paper 10 to be creased has a doubled-over flap 12 of a preselected width pinched between a person's left thumb and forefinger to hold the paper. As is customary, the right thumb and forefinger also pinch the starting point S of a line 18 to be creased and then are drawn away from an edge 14 of the sheet to create the crease. Let it be understood that the word "fingers" are used generically herein to encompass any five fingers of a hand, including a thumb. This is necessitated due to the fact that it is possible to employ the device of my invention with fingers other than a thumb, although the desired controllable creasing pressure is believed best developed between a thumb and forefinger. It should also be understood that the crease line 18 can be formed either right or left handed according to the person's inclination and preference. Several illustrated versions of the device may be used with either hand. Those that cannot be used ambidextrously can be manufactured for use by either a right-handed or left-handed person.

A finger-protecting creasing device 16 is shown as being held between the thumb and forefinger of the right hand to pinch the sheet 10 at point S and apply pressure to the crease line 18. The device 16 is then drawn in the direction of arrow 20 in very much the same fashion as can be customarily done between one's finger and thumb tips. The paper can be creased with controllable thumb pressure applied directly over line 18 for a sharp or somewhat sharp crease, or the crease can be made closer to the throat of the device (with the thumb and finger tips inwardly of the line 18) with reduced pressure being applied, if a more gentle (less sharp) crease is desired.

The device 16 of one preferred form of my invention is shown in FIGS. 2–6. It consists of a pair of slightly flexible arms 22 and 24, a hinge portion 26 and at least one side wing or flange 28. Ideally, parts 22, 24, 26 and 28 are integral and made of plastic for purposes of long life, but it can also be made of several components and of other materials. The hinge, when the device is made of plastic, may be a conventional "living hinge" with a throat portion 29. Considered within the scope of the term hinge is anything which allows the device 16 to be open (V-shaped) at the end opposite the hinge for placement over a line to be creased when the device is inactive, and then permits arm 22 to be relatively movable toward arm 24 to an active creasing condition to the dotted line positions shown in FIGS. 2 and 10. In such creasing condition, arms 22 and 24 are essentially parallel, at least at the section where finger pressure is applied. A flexible arm such as illustrated in FIG. 10 may be considered hinged for purposes of this invention, for example. The arms 22 and 24 have opposing facing creasing surfaces X and Y, which, when the arms are brought together as in FIGS. 2 an 10, establish a fairly large area of surface contact between the creasing surfaces and the sheet being creased.

The form of article shown in FIGS. 2–6 also incorporates an envelope-opening, paper-slitting feature and a paper-combing feature. Envelope opening is performed by slitting with a stiletto-type guide 23 having a pointed tip 25 and an opening 27 extending lengthwise between the guide 23 and the adjacent edge of flange 28. The guide 23 may have a sharpened edge 31, and may even be provided with an embedded razor edge 33 (FIG. 4), or can have both. As the function of such an envelope opener is well known, it need not be further described here, except to say that the envelope would be slit by entering tip 25 into an open corner below a flap 21 as shown in FIG. 4, with the guide 23 then being moved in the direction of arrow 19. A bulbous portion 17 may be provided on one or both sides of the end of the guide 23 opposite from tip 25 to spread the envelope during slitting.

The combination creaser/slitter is also an excellent tool for separating printed roll facsimile (FAX) paper into sheets by starting at one end of the long printed section, creasing the line between the first and second pages, then, while still holding the device 16 in the same manner, drawing the slitter toward one's self as in FIG. 4. This can be repeated for the entire length of paper without ever releasing the device, placing the sheets in numerical order as they are severed.

In addition, a resilient friction-creating comb or snubber 35 is provided at the cantilevered or distal end on the outer surface of the arm 22, and is used to comb sheets by pushing them in from one pile edge or corner as shown in FIG. 6. Sheets can also be combed by pulling them from the opposite side or corner of the sheet stack.

For ease of picking up device 16 as well as using it for display purposes to be described later, arms 22 and 24 are desired to be of the same length. This enables the device to be stood upright on a surface 32, e.g., the top of a desk (FIG.2). When so standing and with the flange 28 being located away from the user, it becomes simple for the person to place the forefinger and middle finger over the flange 28, capture it between those fingers and lift it into ready position for placement over a sheet fold and creasing it. Finger placement is depicted in FIG. 3, where the two dotted-line circles on opposite sides of the flange 28 are representative of the forefinger and middle finger. The thumb is also shown in dotted lines in FIG. 2, ready to apply pressure to the arm 22 and paper sheet 10 at the crease line 18. This is accomplished by relatively pressing arm 22 and arm 24 toward each other in a pinching-type motion. The reason I have illustrated a thumb against arm 22 in FIGS. 1–2 is that greater pressure can normally be applied by a thumb as compared to a finger, such as when folding and creasing multiple sheets. The thumb also seems better able to control the amount of pressure applied, depending on how little or how much pressure is desired to form a specific sharpness of crease. FIG. 3 shows a flange 28' in dotted lines. Both flanges 28 and 28' may be used on the device to make it usable by either a right or left handed person, although for cost reasons, when the creaser is combined with a slitter, only one flange should be used. When two flanges are used (as will be seen in conjunction with FIGS. 7–10), the flanges grip the sides of the forefinger lightly and keep the device from falling from the user's hands if other tasks are also being undertaken while creasing is intended to continue.

FIG. 5 illustrates a slight modification from the preferred form of device, shown as 16B. In this version, the slitter-carrying flange 28B is located centrally of arm 24B. This makes a single flange readily usable by either a right or left handed person. It will be noted from several of the views that the outer tips or ends of the arms 22 and 24 are perpendicular to the length of the arms, making the ends squared or blunt. This is what enables the device to stand upright and vertically on surface 32, in inverted V fashion. Flange 28B is easily gripped between the forefinger and middle finger of either a right or left hand in the same manner as gripping the flange of device 16.

FIG. 7 illustrates one manner in which a simplified version of the device 16C dedicated solely to creasing can be produced, preferably with a pair of flanges 28C. It can be made from flat stock and thinned out by a creasing tool to form hinges 34 and 36. Hinge 36 is designed to maintain an acute angle as at throat portion 29 of FIG. 2, but hinges 34 are adapted to lay flanges 28C somewhat open relative to arm 24C as shown in FIG. 8 when the device 16C is resting on a desktop or surface 32. This enables better viewing of a message on the face of the device 16C when seen from across a desk by a visitor. As device 16C is picked up between a forefinger and middle finger, thumb contact with arm 22C places all parts in creasing position. A logo or advertising message may be printed or otherwise formed in what will become the outer surfaces of arms 22C, 24C and 28C when the device is made to stand on the surface 32.

Flanges 28, 28B and 28 C constitute a slippage-resisting gripping means to maintain the device firmly under control as it is drawn along the crease. In effect, the flanges are a positive means to prevent the fingers from slipping off the device. However, it is also contemplated that frictional means on the outside surfaces of arms 22 and 24 may also perform to some extent, although not as well.

FIGS. 9 and 10 show another modified form of creasing device 16D. FIG. 9 is a view taken from above, looking in the same direction as in FIGS. 3 and 5, while FIG. 10 is a cross-section of FIG. 9 taken along lines 10—10. This version has a ring portion 40 which may be open as at 42 to accommodate fingers of different diameters. Clearly, this variation is best molded from thermoplastic, one having sufficient resilience to enable expansion and contraction to be received by large or small fingers. FIG. 10 illustrates multiple sheets being creased, e.g., a multi-part computer form. Arm 22D is shown somewhat flexed adjacent the hinge end, this showing being exaggerated to illustrate what can occur when a simple bend forms the hinge and the arm 22D is capable of slight flexing.

Whether the device is dedicated solely to creasing or also includes the slitting or sheet combing features, it is always held the same way. This is illustrated by the dotted-line fingers in FIG. 2 and 4. It should be understood that the same manner of finger gripping is also used whether sheet combing as in FIG. 8 or the slitting of roll facsimile paper.

Depending on the particular form of device, one or more exposed surfaces can carry a logo or advertising message (FIG. 8). Since the device can be made to stand upright on the blunt ends of the arms for grasping by the user, the logo should be made to be readable when the device is upright. This advantageously exposes the user or a visitor at the user's desk to the logo. This makes the device an exceptional promotional item for products and services associated with business use. It can also be handed out as a business card which serves both functionally as a creaser as well as a promotional item. Such a business card version can be carried flat in a wallet or card case with only the hinge 36 folded over while in the flat condition. The card is always viewable (if kept ready for use on one's desk), serving as a constant reminder to use a certain product, restaurant or purchase supplies from a certain supplier, etc.

It can be seen that my invention lends itself to many differently-designed forms, and the illustrated forms are not intended to limit the claims only to those variations shown. Various other modifications can be made without departing from the spirit and scope of the invention.

Having described my invention, I claim:

1. An open-ended finger-protecting device for forming a crease in a doubled-over paper sheet along a line extending away from a given sheet edge by supporting the device with at least one finger of one hand and with an open end of said finger-protecting device placed on opposite sides of the doubled-over sheet to be creased, compressing the sheet adjacent said line and then laterally drawing the device from said given edge to a location remote from said given edge along the crease to be formed, said device comprising:

a pair of laterally-positioned elongated arms having facing pressure-applying creasing surfaces and each having dimensions sufficient to essentially protect a person's fingers from contact with said paper sheet when the device is drawn along the line to be creased; said arms being of essentially the same length and having blunt distal ends, said arms at said blunt distal ends being sufficiently wide to enable the device to stand upright by means of said blunt ends on a flat horizontal surface;

a hinge portion connecting said arms at one end and forming a throat portion open from said hinge portion toward remote ends of said arms, said hinge portion enabling pressure to be controllably applied by the person's fingers to said arms when closing said throat portion and urging said creasing surfaces together; and gripping means connected to at least one of said arms resisting slippage of the person's fingers from said arms as they are drawn laterally along the crease to be formed with their pressure-applying surfaces pressed against the paper sheet.

2. The device according to claim 1 wherein said gripping means comprises a flange extending lengthwise of one of said arms.

3. The-device according to claim 2 wherein said flange extends along an edge of said one arm.

4. The device according to claim 2 wherein said flange extends essentially centrally along said one arm.

5. The device according to claim 1 wherein indicia is provided on outwardly-facing surfaces of at least one of said arms, said indicia being readable while said device is supported in said upright condition on said horizontal surface.

6. The device according to claim 2 wherein said flange extends essentially perpendicular to said one arm and has a lengthwise-extending slitting means at its edge remote from said arm, said slitting means comprising an edge-sharpened stiletto end and an adjacent lengthwise-extending relief opening facing outwardly away from the hinge portion end of the device, whereby the stiletto end of said slitting means may enter a flap corner of a sealed envelope and be drawn along the flap to open the envelope, with said device being firmly finger-gripped during such slitting in the same manner as it is gripped during pressure creasing of paper.

7. An open-ended, essentially V-shaped finger-protecting device for forming a crease in a doubled-over paper sheet along a line extending perpendicularly from a given sheet edge by (a) supporting the device with at least one finger of one hand and placing a open end of the device around opposite sides of said line of the doubled-over sheet edge to be creased, (b) compressing the sheet by means of said device along said line and then (c) laterally drawing the device from said given edge to a location remote from said given edge along the crease to be formed while maintaining the compression, said device comprising:

a pair of arms movable between an open inactive condition when placed around said sheet and an active sheet-compressing creasing condition, said arms having opposed, inwardly-facing pressure-applying creasing surfaces therebetween and each arm having a lateral width sufficient to essentially protect the person's fingers from contact with said sheet when the device is drawn along the line to be creased; said arm being of essentially the same length and having blunt distal ends, said arms at said blunt distal ends being sufficiently wide to enable the device to stand upright by means of said blunt ends on a flat horizontal surface;

a hinge portion connecting said arms at their ends remote from said open end for enabling pressure-controlled movement of the arms by the person's fingers between said inactive condition and said active condition; and gripping means connected to at least one of said arms resisting lateral slippage of the person's fingers from said arms as the device is drawn laterally along the crease to be formed with said pressure-applying surfaces pressed against the paper sheet.

8. The device according to claim 7 wherein said pair of arms includes a first arm and a second arm, and said gripping means comprises a flange extending lengthwise of said first arm.

9. The device according to claim 8 wherein said flange is gripped between a pair of adjacent fingers, and a thumb of the same hand moves the second arm to apply pressure to the line to be creased.

10. The device according to claim 8 wherein said flange extends essentially perpendicular to said one arm and has a lengthwise-extending slitting means at its edge remote from said arm, said slitting means comprising an edge-sharpened stiletto end and an adjacent lengthwise-extending relief opening facing outwardly away from the hinge portion end of the device, whereby the stiletto end of said slitting means may enter a flap corner of a sealed envelope and be drawn along the flap to open the envelope, with said device being firmly finger-gripped during such slitting in the same manner as it is gripped during pressure creasing of paper.

11. The device according to claim 8 wherein indicia is provided on outwardly-facing surfaces of at least one of said arms, said indicia being readable while said device is supported in said upright condition on said horizontal surface.

12. A combination printed information medium and open-ended finger-protecting device for (1) conveying an advertising message and (2) forming a crease in a doubled-over paper sheet along a line extending away from a given sheet edge by supporting the device with at least one finger of one hand and with an open end of said finger-protecting device placed on opposite sides of the doubled-over sheet to be creased, compressing the sheet adjacent said line and then laterally drawing the device from said given edge to a location remote from said given edge along the crease to be formed, said device comprising:

a pair of laterally-positioned elongated arms having facing pressure-applying creasing surfaces and each having a width sufficient to essentially protect the person's fingers from contact with said paper sheet when the device is drawn along the line to be creased;

said arms being of the same length having blunt distal ends, said blunt distal ends therefore enabling said finger-protecting device to stand in an upright position on a flat horizontal surface, ready to be gripped for use;

indicia provided on an outwardly-facing surface of at least one of said arms, said indicia being upright readable while said device is supported in said upright condition on said horizontal surface;

a hinge portion connecting said arms at one end and forming a throat portion open from said hinge portion toward said distal ends of said arms, said hinge portion enabling pressure to be controllably applied to said arms when closing said throat portion and urging said creasing surfaces together; and a flange connected to a side edge of one of at least one of said arms, resisting slippage of the person's fingers from said arms as they are drawn laterally along the crease to be formed with their pressure-applying surfaces pressed against the paper sheet.

13. The invention set forth in claim 12 wherein flanges are provided on both side edges of said one arm.

14. The invention set forth in claim 13 wherein each flange is hinged to said one arm at said side edges, said hinges allowing a gripped flange to be placed at approximately 90 degrees to said one arm during use as a creaser, but essentially opening said flanges and said one arm to a relatively flat state during placement of said device on said horizontal surface.

15. The invention set forth in claim 12 wherein said connected flange is hinged to said one arm at a side edge of said arm, said hinge allowing the gripped flange to be placed at approximately 90 degrees to said one arm during use as a creaser, but essentially opening said flanges and said one arm to a relatively flat state during placement of said device on said horizontal surface, and wherein said arms, when the device is resting on said surface, remain at its acute angle to enable its standing upright on said surface, ready for its next creasing use.

* * * * *